US008547283B2

(12) United States Patent
Wong et al.

(10) Patent No.: US 8,547,283 B2
(45) Date of Patent: Oct. 1, 2013

(54) MULTIBAND ANTENNA AND METHOD FOR AN ANTENNA TO BE CAPABLE OF MULTIBAND OPERATION

(75) Inventors: Kin-Lu Wong, Kaohsiung (TW); Ming-Fang Tu, Hsinchu (TW); Wei-Yu Li, Yilan (TW); Chun-Yih Wu, Taipei (TW)

(73) Assignees: Industrial Technology Research Institute, Hsinchu (TW); National Sun-Yat-Sen University, Kaohsiung (TW)

( * ) Notice: Subject to any disclaimer, the term of this patent is extended or adjusted under 35 U.S.C. 154(b) by 329 days.

(21) Appl. No.: 13/013,623

(22) Filed: Jan. 25, 2011

(65) Prior Publication Data

US 2012/0001815 A1 Jan. 5, 2012

(30) Foreign Application Priority Data

Jul. 2, 2010 (TW) ..... 99121914 A

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 846
See application file for complete search history.

(56) References Cited

U.S. PATENT DOCUMENTS 5,434,579 A 7/1995 Kagoshima et al.
5,835,063 A 11/1998 Brachat et al.
6,614,400 B2 9/2003 Egorov
6,650,294 B2 11/2003 Ying et al.
6,680,705 B2 1/2004 Tan et al.
6,774,850 B2 8/2004 Chen
6,788,257 B2 9/2004 Fang et al.
6,801,168 B1 10/2004 Yeh
6,917,339 B2 7/2005 Li et al.

(Continued)

FOREIGN PATENT DOCUMENTS

CN 1886863 A 12/2006
CN 101273492 A 9/2008
EP 1 345 282 9/2003
WO WO 02/078123 10/2002

OTHER PUBLICATIONS

European Search Report dated Oct. 17, 2011.

(Continued)

*Primary Examiner* — Hoanganh Le
(74) *Attorney, Agent, or Firm* — McClure, Qualey & Rodack, LLP

(57) ABSTRACT

A multiband antenna having a ground plane and a radiating portion is provided. The radiating portion includes a first metal portion, a second metal portion, an inductively-coupled portion, and a third metal portion. The first metal portion has a first coupling metal portion and a signal feeding line electrically connected thereto. The second metal portion has a second coupling metal portion and a shorting metal portion electrically connected thereto with a shorting point connected to the ground plane. The first and second coupling metal portions are coupled and a capacitively-coupled portion is formed therebetween. The inductively-coupled portion is connected between the third and second metal portions. The first and second metal portions enable the antenna to generate a first operating band. The first, second and third metal portions enable the antenna to generate a second operating band, the frequencies of which are lower than those of the first operating band.

25 Claims, 15 Drawing Sheets

(56) References Cited

U.S. PATENT DOCUMENTS

| | | | | |
|---|---|---|---|---|
| 6,977,616 | B2 | 12/2005 | Yuanzhu | |
| 6,985,108 | B2 | 1/2006 | Mikkola et al. | |
| 7,026,999 | B2 | 4/2006 | Umehara et al. | |
| 7,119,743 | B2 * | 10/2006 | Iguchi et al. | 343/700 MS |
| 7,215,289 | B2 | 5/2007 | Harano | |
| 7,242,364 | B2 | 7/2007 | Ranta | |
| 7,256,743 | B2 | 8/2007 | Korva | |
| 7,315,289 | B2 | 1/2008 | Puente Baliarda et al. | |
| 7,339,531 | B2 | 3/2008 | Desclos et al. | |
| 7,425,924 | B2 | 9/2008 | Chung et al. | |
| 7,482,984 | B2 | 1/2009 | Rosengren et al. | |
| 7,848,771 | B2 * | 12/2010 | Boyle | 455/550.1 |
| 8,077,116 | B2 * | 12/2011 | Shamblin et al. | 343/895 |
| 8,325,103 | B2 * | 12/2012 | Autti | 343/904 |
| 2003/0098812 | A1 | 5/2003 | Ying et al. | |
| 2005/0280579 | A1 | 12/2005 | Liang et al. | |
| 2007/0146212 | A1 | 6/2007 | Ozden et al. | |
| 2007/0257842 | A1 | 11/2007 | Tseng | |
| 2009/0256763 | A1 | 10/2009 | Chi et al. | |
| 2009/0273521 | A1 | 11/2009 | Wong et al. | |
| 2009/0273530 | A1 | 11/2009 | Chi et al. | |

OTHER PUBLICATIONS

Yeh, S.H., et al; "Compact Dual-Frequency PIFA with a Chip-Inductor-Loaded Rectangular Spiral Strip;" Microwave and Optical Technology Letters; vol. 33; No. 6; Jun. 20, 2002; pp. 394-397.

Wong, K.L., et al; "Printed Single-Strip Monopole Using a Chip Inductor for Penta-Band WWAN Operation in the Mobile Phone;" IEEE Transactions on Antennas and Propagation; Vo. 58; No. 3; Mar. 2010; pp. 1011-1014.

Wong, K.L., et al.; "Printed Loop Antenna with a Perpendicular Feed for Penta-Band Mobile Phone Application;" IEEE Transactions on Antennas and Propagation; vol. 56; No. 7; Jul. 2008; pp. 2138-2141.

Wong, K.L., et al.; "Printed PIFA with a Coplanar Coupling Feed for Penta-Band Operation in the Mobile Phone;" Microwave and Optical Technology Letters; vol. 50; No. 12; Dec. 2008; pp. 3181-3186.

Chi, Y.W., et al.; "Half-Wavelength Loop Strip Capacitively Fed by a Printed Monopole for Penta-Band Mobile Phone Antenna;" Microwave and Optical Technology Letters; vol. 50; No. 10; Oct. 2008; pp. 2549-2554.

Chang, C.H., et al.; "GSM580/900/1800/1900/UMTS Coupled-Fed Planar λ/8-PIFA for Internal Mobile Phone Antenna;" Microwave and Optical Technology Letters; vol. 51; No. 4; Apr. 2009; pp. 1091-1096.

Chi, Y.W., et al.; "Very-Small-Size Printed Loop Antenna for GSM/DCS/PCS/UMTS Operation in the Mobile Phone;" Microwave and Optical Technology Letters; vol. 51; No. 1; Jan. 2009; pp. 184-192.

Chi, Y.W., et al.; "Quarter-Wavelength Printed Loop Antenna with an Internal Printed Matching Circuit for GSM/DCS/PCS/UMTS Operation in the Mobile Phone;" IEEE Transactions on Antennas and Propagation; vol. 57; No. 9; Sep. 2009; pp. 2541-2547.

Kang, T.W., et al.; "Chip-Inductor-Embedded Small-Size Printed Strip Monopole for WWAN Operation in the Mobile Phone;" Microwave and Optical Technology Letters; vol. 51; No. 4; Apr. 2009; pp. 966-971.

Villanen, J., et al.; "A Coupling Element-Based Quad-Band Antenna Structure for Mobile Terminals;" Microwave and Optical Technology Letters; vol. 49; No. 6; Jun. 2007; pp. 1277-1282.

Chi, Y.W., et al.; "Internal Compact Dual-Band Printed Loop Antenna for Mobile Phone Application;" IEEE Transactions on Antennas and Propagation; vol. 5; No. 5; May 2007; pp. 1457-1462.

Li, R.L., et al.; "Broadband Loop Antenna for DCS-1088/IMT-2000 Mobile Phone Handsets;" IEEE Microwave and Wireless Components Letters; vol. 12; No. 8; Aug. 2002; pp. 305-307.

English Abstract translation of CN1886863 (Published Dec. 27, 2006).

English language translation (machine translation) of CN101273492 (published Sep. 24, 2008).

CN Office Action dated May 28, 2013.

* cited by examiner

MULTIBAND ANTENNA AND METHOD FOR AN ANTENNA TO BE CAPABLE OF MULTIBAND OPERATION

This application claims the benefit of Taiwan application Serial No. 99121914, filed Jul. 2, 2010, the subject matter of which is incorporated herein by reference.

TECHNICAL FIELD

The disclosure relates in general to an antenna, and more particularly to an antenna the operating bandwidth of which covers several operating bands and a method for an antenna to be capable of multiband operation.

BACKGROUND

In comparison to the second or third generation mobile communication system, e.g. GSM/UMTS (Global System for Mobile Communication/Universal Mobile Telecommunication System) systems, the fourth generation mobile communication system, e.g. LTE (Long Term Evolution) system, could achieve higher wireless uploading and downloading data rates, and could provide the users with better mobile broadband Internet and wireless multi-media service.

In order to reduce the opportunity of users having to change mobile phones for different mobile communication systems used in different countries or areas, the mobile communication devices of LTE system must also be capable of GSM/UMTS operations. Thus, a compact antenna whose operating bands could meet the bandwidth requirements of LTE, GSM, and UMTS systems for multiband and wideband operation has become an important study topic.

For designing a single antenna to meet the bandwidth requirement of dual-band operation for GSM850/GSM900 systems (824~960 MHz), operating bandwidth of the antenna around 890 MHz must be larger than 136 MHz (the fractional bandwidth is about 16%). However, for designing a single antenna to meet the bandwidth requirement of tri-band operation for LTE700/GSM850/GSM900 systems (698~960 MHz), operating bandwidth of the antenna around 830 MHz must be larger than 260 MHz (the fractional bandwidth is about 30%), wherein the required operating bandwidth is nearly doubled. Besides, it is even more difficult for the case of designing the single antenna capable of LTE700/GSM850/GSM900 operation to further meet the bandwidth requirement of penta-band operation for GSM1800/GSM1900/UMTS/LTE2300/LTE2500 systems (1710~2690 MHz) at higher frequency bands simultaneously, that is, operating bandwidth of the antenna around 2200 MHz must also be larger than 460 MHz (the fractional bandwidth is larger than 40%).

Thus, it is indeed a challenge of designing a single antenna to meet bandwidth requirements of the tri-band operation for LTE700/GSM850/GSM900 systems and the penta-band operation for GSM1800/GSM1900/UMTS/LTE2300/LTE2500 systems in a limited space of a mobile communication device.

SUMMARY

Embodiments of a multiband antenna and a method for an antenna to be capable of multiband operation are provided. The technical problems mentioned above could be resolved in some practical examples according to the embodiments below.

According to an embodiment of this disclosure, a multiband antenna comprising a ground plane and a radiating portion is provided. The radiating portion comprises a first metal portion, a second metal portion, an inductively-coupled portion, and a third metal portion. The first metal portion comprises a first coupling metal portion and a signal feeding line, which is electrically connected to the first coupling metal portion and has a signal feeding point. The second metal portion comprises a second coupling metal portion and a shorting metal portion, which is electrically connected to the second coupling metal portion and has a shorting point electrically connected to the ground plane. The second coupling metal portion is coupled to the first coupling metal portion and a capacitively-coupled portion is formed between the first and the second coupling metal portions. The inductively-coupled portion is connected between the third and the second metal portion. The first and the second metal portions enable the multiband antenna to generate a first operating band. The first, the second and the third metal portion enable the multiband antenna to generate a second operating band. The frequencies of the second operating band are lower than those of the first operating band.

According to another embodiment of this disclosure, a method for an antenna to be capable of multiband operation, for use in a communication device, is provided. The method comprises the following steps. An inductively-coupled portion is connected between an open-loop metal portion and an extended metal portion to form an antenna. In the antenna, the open-loop metal portion comprises a first metal portion connected to a signal source and at least one second metal portion shorted to a ground plane, wherein there is at least one capacitively-coupled portion to be formed between the first metal portion and the at least one second metal portion. When the antenna operates at a higher frequency band, the inductively-coupled portion enables the open-loop metal portion to equivalently perform as another open-loop antenna to generate a first operating band for the antenna. When the antenna operates at a relatively lower frequency band, the open-loop metal portion equivalently performs as a feeding-matching portion of the extended metal portion to enable the antenna to generate a second operating band. The frequencies of the second operating band are lower than those of the first operating band.

The above and other aspects of the disclosure will be understood clearly with regard to the following detailed description of the preferred but non-limiting embodiment (s). The following description is made with reference to the accompanying drawings.

DETAILED DESCRIPTION

The disclosure provides a number of embodiments of a multiband antenna and a method for an antenna to be capable of multiband operation. The embodiments could be used in various communication devices such as mobile communication or computing devices, computer devices, telecommunication or network devices, and peripheral devices of computers or network systems.

Figure 1:
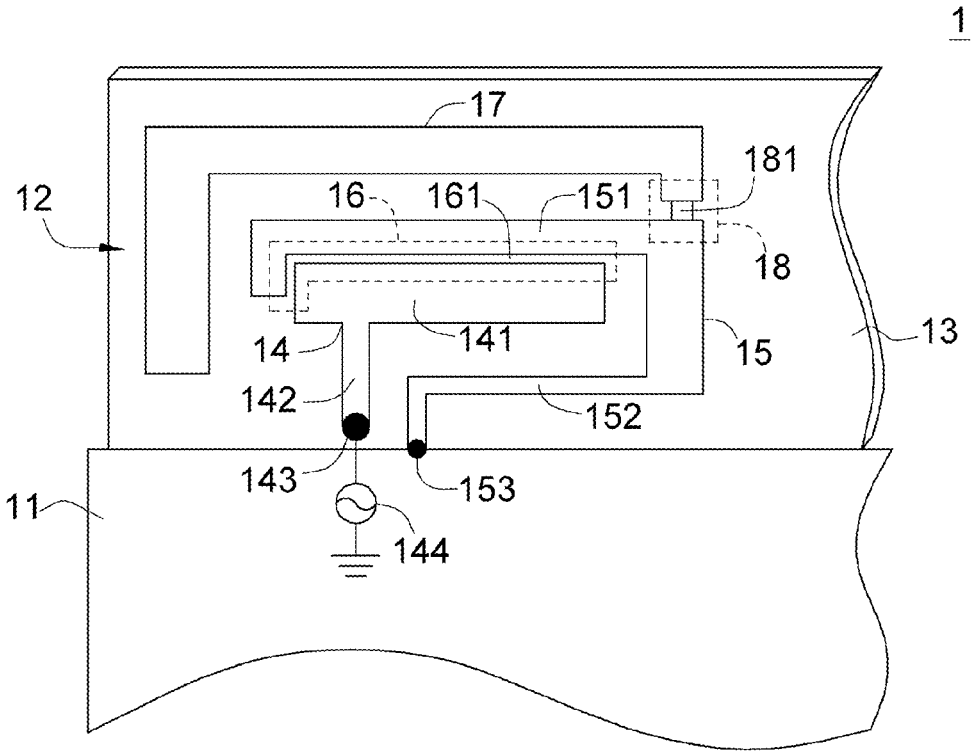
FIGS. 1 and 2 respectively show a schematic diagram of a multiband antenna 1 according to an embodiment of this disclosure and the corresponding measured return loss of the multiband antenna 1.

FIG. 1 shows a schematic diagram of a multiband antenna 1 according to an embodiment of this disclosure. The multiband antenna 1 comprises a ground plane 11 and a radiating portion 12 disposed on a dielectric substrate 13, wherein the radiating portion 12 comprises a first metal portion 14, a second metal portion 15, a third metal portion 17, and an inductively-coupled portion 18. The first metal portion 14 comprises a first coupling metal portion 141 and a signal feeding line 142. The signal feeding line 142 is electrically connected to the first coupling metal portion 141 and has a signal feeding point 143. The signal feeding point 143 is connected to a signal source 144. The second metal portion 15 comprises a second coupling metal portion 151 and a shorting metal portion 152. The shorting metal portion 152 is electrically connected to the second coupling metal portion 151 and has a shorting point 153 electrically connected to the ground plane 11. The second coupling metal portion 151 is coupled to the first coupling metal portion 141 to form a capacitively-coupled portion 16, wherein there is a coupling slit 161 between the second coupling metal portion 151 and the first coupling metal portion 141. The inductively-coupled portion 18 is connected between the third metal portion 17 and the second metal portion 15. The inductively-coupled portion 18 has a lumped inductor 181. The first metal portion 14 and the second metal portion 15 enable the multiband antenna 1 to generate a first operating band 21. The first metal portion 14 and the second metal portion 15 and the third metal portion 17 enable the multiband antenna 1 to generate a second operating band 22. The frequencies of the second operating band 22 are lower than those of the first operating band 21.

Figure 2:
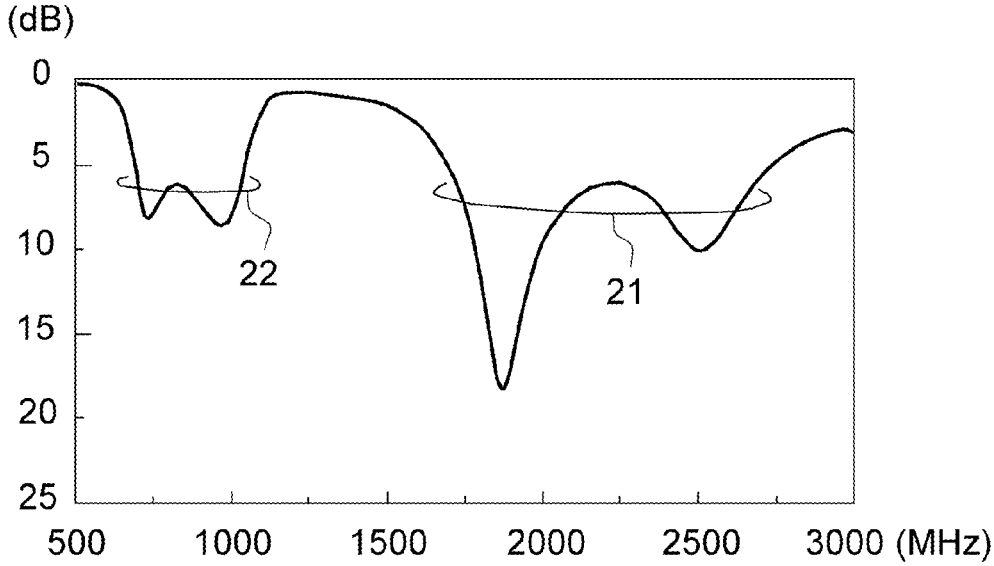

FIG. 2 shows the measured return loss of the multiband antenna 1 of FIG. 1. The experiment is conducted with the following measurements. The ground plane 11 has a length of about 100 mm, and a width of about 50 mm. The dielectric substrate 13 has a height of about 15 mm, a width of about 50 mm and a thickness of about 0.8 mm. For the first coupling metal portion 141 of the first metal portion 14, the length is about 19 mm, and the width is about 3 mm. For the signal feeding line 142 of the first metal portion 14, the length is about 7 mm, and the width is about 1.5 mm. For the capacitively-coupled portion 16, the gap of the coupling slit 161 is about 0.3 mm, and the gap of the coupling slit 161 should be less than or equal to one-hundredth wavelength of the lowest operating frequency of the second operating band 22 (698 MHz for example) so as to provide sufficient capacitive coupling for the multiband antenna 1. For the second coupling metal portion 151 of the second metal portion 15, the total length is about 32 mm, and the width is about 1.5 mm. For the shorting metal portion 152 of the second metal portion 15, the total length is about 24 mm, and the width is about 1 mm. For the third metal portion 17, the total length is about 44 mm, the width is about 2.5 mm, and the length of the third metal portion should be less than or equal to one-fifth wavelength of the lowest operating frequency of the second operating band 22. The inductance of the lumped inductor 181 of the inductively-coupled portion 18 is about 8.2 nH. The inductively-coupled portion 18 performs as a low-pass filter which has high input impedance at a higher frequency band of the antenna. Thus, an open-loop antenna could be equivalently formed by the first metal portion 14 and the second metal portion 15 at the higher frequency band. Moreover, the capacitively-coupled portion 16 between the first metal portion 14 and the second metal portion 15 could enable the open-loop antenna to generate a wideband resonant mode at the higher frequency band, so that the first operating band 21 of the multi-band antenna 1 could be formed with a wide operating bandwidth. Besides, the capacitively-coupled portion 16 and the shorting metal portion 152 of the second metal portion 15, at a relatively lower frequency band, could equivalently perform as a feeding-matching portion of the multiband antenna 1 for effectively improving the impedance matching of the resonant mode generated at the lower frequency band, so that the second operating band 22 of the multiband antenna 1 could be formed with a wide operating bandwidth. From the experimental results, based on the 6 dB return loss definition acceptable for practical application, the first operating band 21 generated by the multiband antenna 1 covers the penta-band operation of GSM1800/GSM1900/UMTS/LTE2300/LTE2500 (1710-2690 MHz) systems, and the second operating band 22 generated by the multiband antenna 1 covers the tri-band operation of LTE700/GSM850/GSM900 (698-960 MHz) systems. Thus, the multiband antenna 1 could meet the bandwidth requirements of the LTE/GSM/UMTS systems for wideband and multiband operation.

Figure 3:
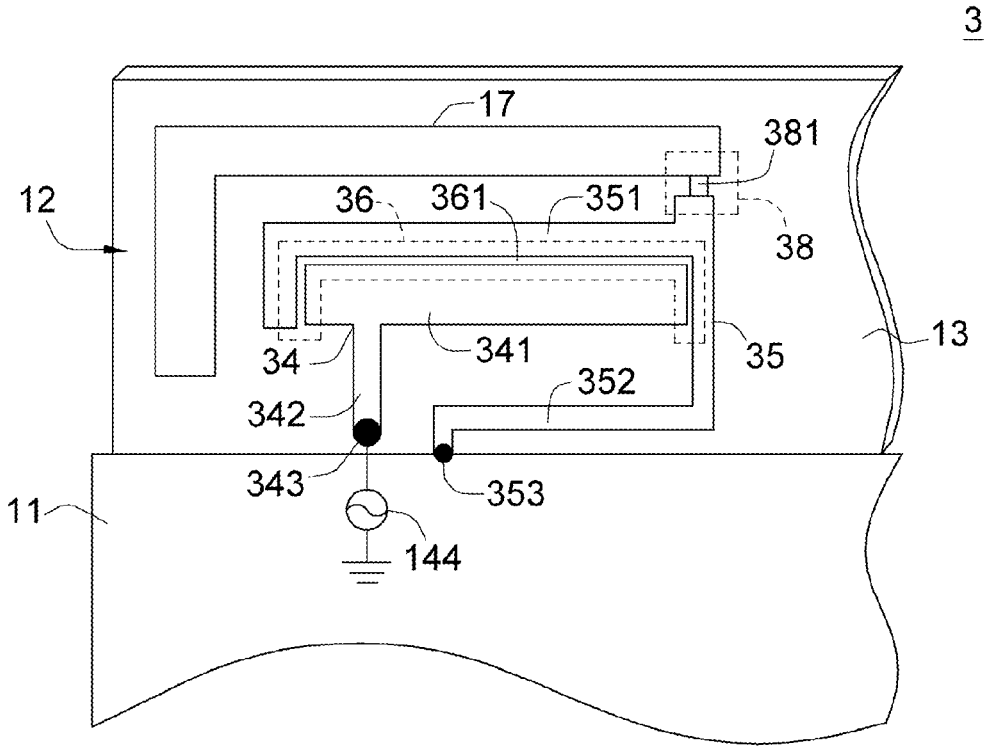
FIGS. 3 and 4 respectively show a schematic diagram of a multiband antenna 3 according to an embodiment of this disclosure and the corresponding measured return loss of the multiband antenna 3.

FIG. 3 shows a schematic diagram of a multiband antenna 3 according to an embodiment of this disclosure. The multiband antenna 3 comprises a ground plane 11 and a radiating portion 12. The radiating portion 12, disposed on a dielectric substrate 13, comprises a first metal portion 34, a second metal portion 35, an inductively-coupled portion 38 and a third metal portion 17. The first metal portion 34 comprises a first coupling metal portion 341 and a signal feeding line 342.

The signal feeding line 342 is electrically connected to the first coupling metal portion 341 and has a signal feeding point 343. The signal feeding point 343 is connected to a signal source 144. The second metal portion 35 comprises a second coupling metal portion 351 and a shorting metal portion 352. The shorting metal portion 352 is electrically connected to the second coupling metal portion 351 and has a shorting point 353 electrically connected to the ground plane 11. The second coupling metal portion 351 is coupled to the first coupling metal portion 341 to form a capacitively-coupled portion 36, wherein there is a coupling slit 361 between the second coupling metal portion 351 and the first coupling metal portion 341. The inductively-coupled portion 38 is connected between the third metal portion 17 and the second metal portion 35. The inductively-coupled portion 38 has a low-pass filter 381.

Figure 4:
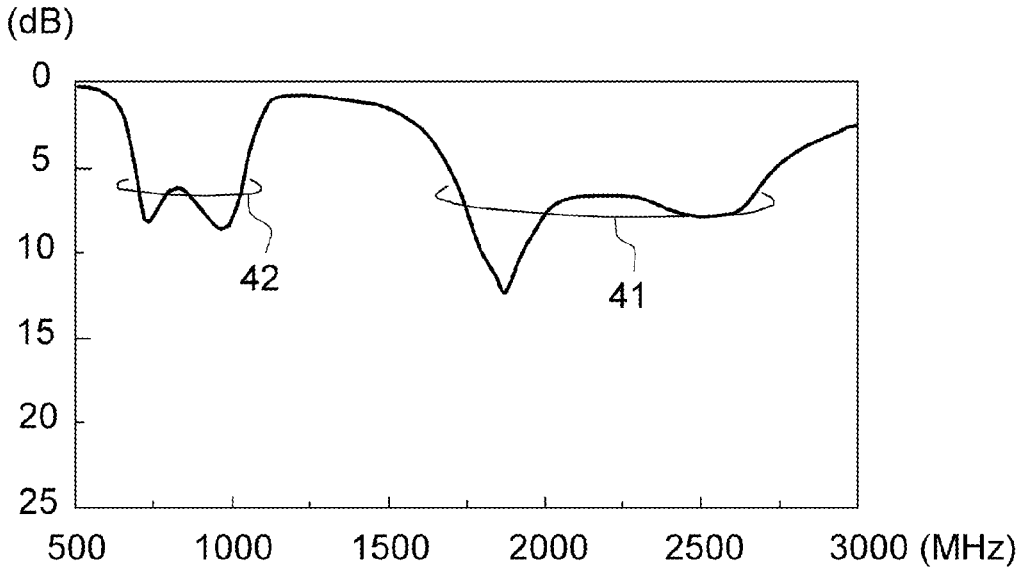

The major difference between the multiband antenna 3 and the multiband antenna 1 is that the lumped inductor 181 is replaced by a low-pass filter 381 whose cutoff frequency is about 1.5 GHz. However, the low-pass filter 381 also has high input impedance when the multiband antenna 3 operates at a higher frequency band, so that the first metal portion 34 and the second metal portion 35 could also equivalently perform as a wideband open-loop antenna at the higher frequency band (similarly, this property could also be achieved by a band-stop filter). In addition, the structural change of the second metal portion 35 shown in FIG. 3 also causes the shape of the coupling slit 361 of the capacitively-coupled portion 36 to be changed accordingly. Nevertheless, by fine tuning the length of the shorting metal portion 352, the capacitively-coupled portion 36 and the shorting metal portion 352 of the second metal portion 35, at a relatively lower frequency band of the multiband antenna 3, could also equivalently perform as a feeding-matching portion of the multiband antenna 3 for effectively improving the impedance matching of the resonant mode generated at the lower frequency band, so that the multiband antenna 3 could generate a second operating band 42 with a wide operating bandwidth. Besides, the capacitively-coupled portion 36 could also provide coupling effect similar to that provided by the capacitively-coupled portion 16 of the multiband antenna 1. That is, the open-loop antenna equivalently formed by the first metal portion 34 and the second metal portion 35 could also generate a wideband resonant mode at the higher frequency band, so that the multiband antenna 3 could generate a first operating band 41 with a wide operating bandwidth. Thus, the antenna performance similar to that of the multiband antenna 1 could also be achieved by multiband antenna 3. FIG. 4 shows the measured return loss of the multiband antenna 3. From the experimental results, based on the 6 dB return loss definition acceptable for practical application, the first operating band 41 generated by the multiband antenna 3 covers the penta-band operation of GSM1800/GSM1900/UMTS/LTE2300/LTE2500 (1710~2690 MHz) systems, and the second operating band 42 generated by the multiband antenna 3 covers the tri-band operation of LTE700/GSM850/GSM900 (698~960 MHz) systems. Thus, the multiband antenna 3 could meet the bandwidth requirements of the LTE/GSM/UMTS systems for wideband and multiband operation.

Figure 5:
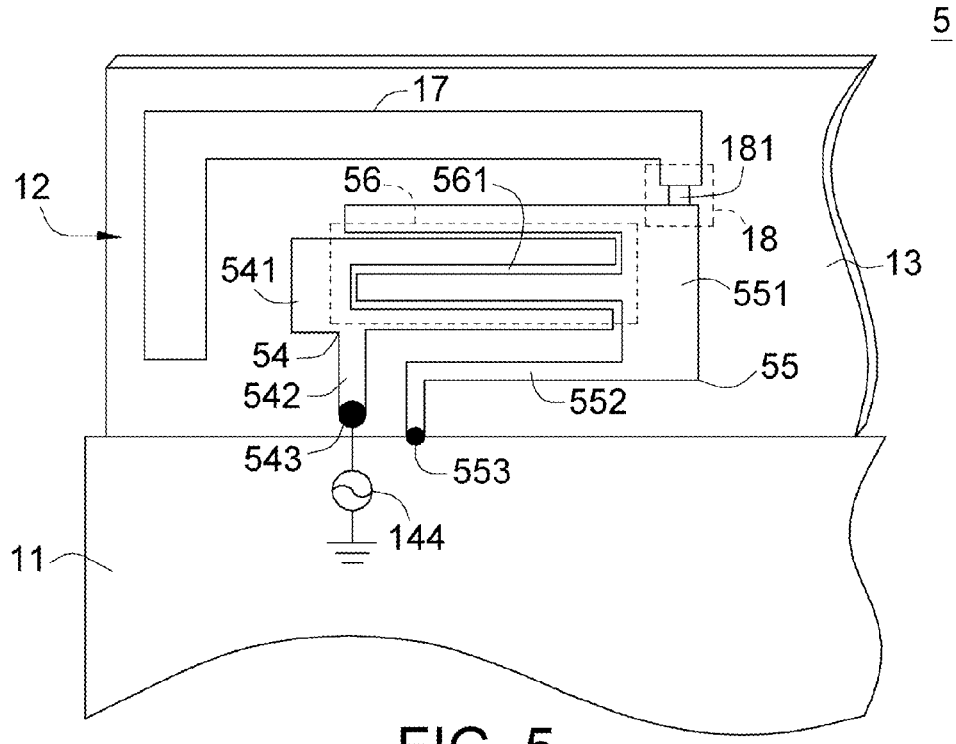
FIG. 5 shows a schematic diagram of a multiband antenna 5 according to an embodiment of this disclosure.

FIG. 5 shows a schematic diagram of a multiband antenna 5 according to an embodiment of this disclosure. The multiband antenna 5 comprises a ground plane 11 and a radiating portion 12. The radiating portion 12, located on a dielectric substrate 13, comprises a first metal portion 54, a second metal portion 55, an inductively-coupled portion 18, and a third metal portion 17. The first metal portion 54 comprises a first coupling metal portion 541 and a signal feeding line 542. The signal feeding line 542 is electrically connected to the first coupling metal portion 541 and has a signal feeding point 543. The signal feeding point 543 is connected to a signal source 144. The second metal portion 55 comprises a second coupling metal portion 551 and a shorting metal portion 552. The shorting metal portion 552 is electrically connected to the second coupling metal portion 551 and has a shorting point 553 electrically connected to the ground plane 11. A meandered coupling slit 561 is constructed between the coupling metal portion 551 and the first coupling metal portion 541 to form a capacitively-coupled portion 56. The inductively-coupled portion 18 is connected between the third metal portion 17 and the second metal portion 55. The inductively-coupled portion 18 has a lumped inductor 181. The major difference between the multiband antenna 5 and the multiband antenna 1 is that the capacitively-coupled portion 56 of the multiband antenna 5 is formed in a type of an interdigital gap capacitor and has a meandered coupling slit 561. However, the capacitively-coupled portion 56 could also provide coupling effect similar to that provided by the capacitively-coupled portion 16 of the multiband antenna 1 of FIG. 1. Thus, the antenna performance similar to that of the multiband antenna 1 could also be achieved by multiband antenna 5.

Figure 6:
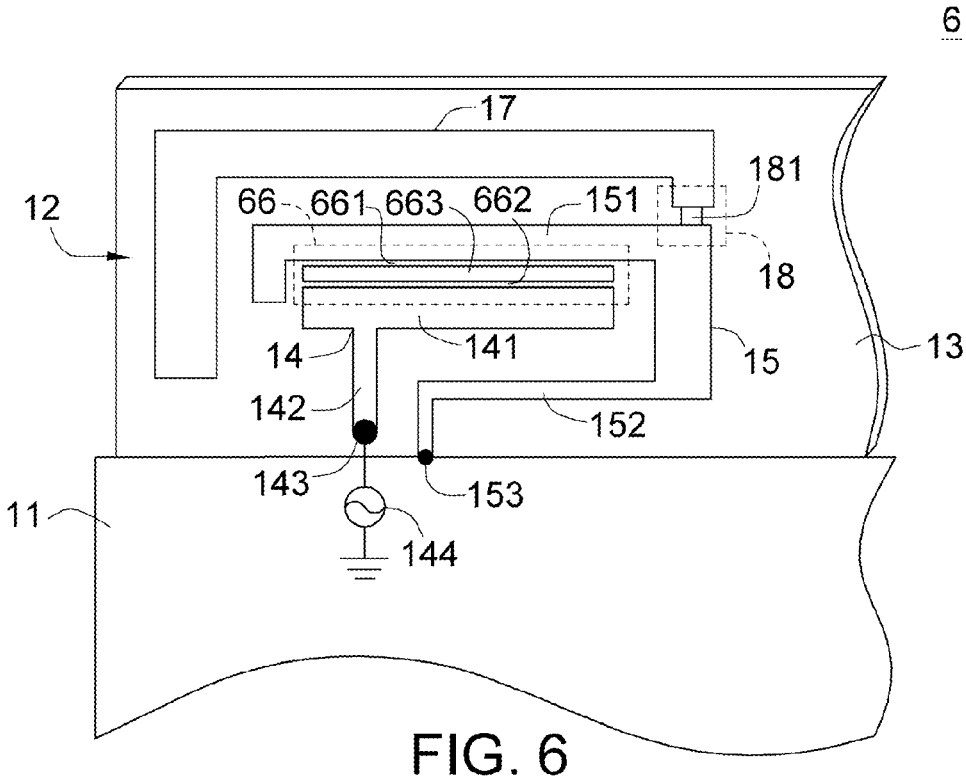
FIGS. 6 and 7 respectively show a schematic diagram of a multiband antenna 6 according to an embodiment of this disclosure and the corresponding measured return loss of the multiband antenna 6.

FIG. 6 shows a schematic diagram of a multiband antenna 6 according to an embodiment of this disclosure. The multiband antenna 6 comprises a ground plane 11 and a radiating portion 12. The radiating portion 12, located on a dielectric substrate 13, comprises a first metal portion 14, a second metal portion 15, an inductively-coupled portion 18, and a third metal portion 17. The first metal portion 14 comprises a first coupling metal portion 141 and a signal feeding line 142. The signal feeding line 142 is electrically connected to the first coupling metal portion 141 and has a signal feeding point 143. The signal feeding point 143 is connected to a signal source 144. The second metal portion 15 comprises a second coupling metal portion 151 and a shorting metal portion 152. The shorting metal portion 152 is electrically connected to the second coupling metal portion 151 and has a shorting point 153 electrically connected to the ground plane 11. The radiating portion 12 further has a metal plate 663 interposed between the second coupling metal portion 151 and the first coupling metal portion 141, wherein the metal plate 663 divides the slit therebetween into slits 661 and 662, to form a capacitively-coupled portion 66. The inductively-coupled portion 18 is connected between the third metal portion 17 and the second metal portion 15. The inductively-coupled portion 18 has a lumped inductor 181. The major difference between the multiband antenna 6 and the multiband antenna 1 is that the capacitively-coupled portion 66 of the multiband antenna 6 is formed in a different capacitor type. However, the capacitively-coupled portion 66 of the multiband antenna 6 could also provide coupling effect similar to that provided by the capacitively-coupled portion 16 of the multiband antenna 1. Thus, the antenna performance similar to that of the multiband antenna 1 could also be achieved by the multiband antenna 6.

Figure 7:
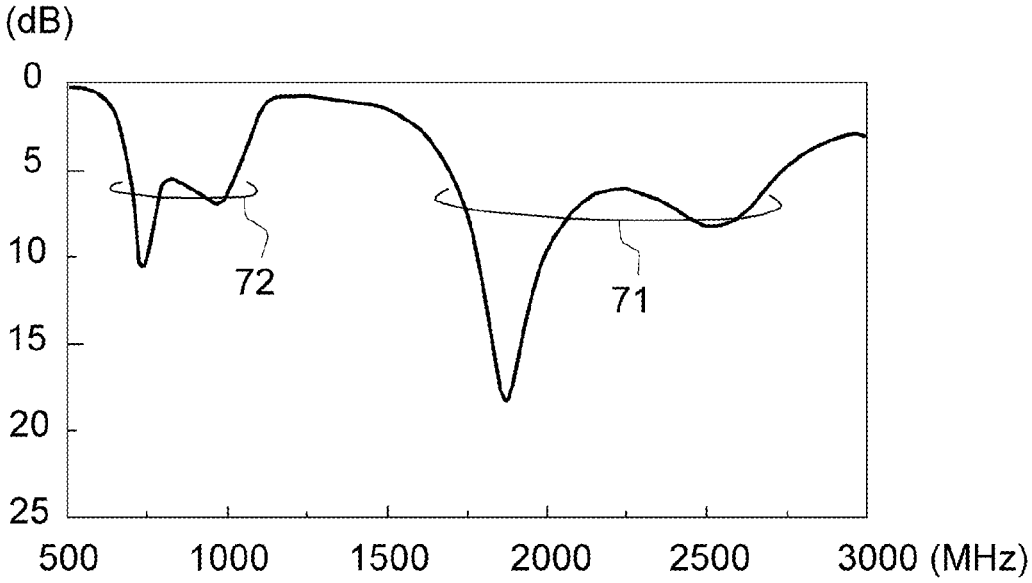

FIG. 7 shows the measured return loss of the multiband antenna 6 of FIG. 6. The experiment is conducted with the following measurements. For the ground plane 11, the length is about 100 mm, and the width is about 50 mm. For the dielectric substrate 13, the height is about 15 mm, the width is about 50 mm, and the thickness is about 0.8 mm. For the first coupling metal portion 141 of the first metal portion 14, the length is about 19 mm, and the width is about 3 mm. For the signal feeding line 142 of the first metal portion 14, the length is about 7 mm, and the width is about 1.5 mm. For the metal plate 663, the length is about 19 mm, and the width is about 0.5 mm. The gap of coupling slit 661 and the coupling slit 662 both are about 0.3 mm, and should be less than or equal to one-hundredth wavelength of the lowest operating frequency of the second operating band 72 (698 MHz for example) so as to provide sufficient capacitive coupling for the multiband antenna 6. For the second coupling metal portion 151 of the second metal portion 15, the total length is about 32 mm, and the width is about 1.5 mm. For the shorting metal portion 152 of the second metal portion 15, the total length is about 24 mm, and the width is about 1 mm. For the third metal portion 17, the total length is about 44 mm, the width is about 2.5 mm, and the length of the third metal portion should be less than or equal to one-fifth wavelength of the lowest operating frequency of the second operating band 72. The inductance of the lumped inductor 181 of the inductively-coupled portion 18 is about 8.2 nH. The inductively-coupled portion 18 performs as a low-pass filter which has high input impedance at a higher frequency band of the antenna. Thus, an open-loop antenna could be equivalently formed by the first metal portion 14 and the second metal portion 15 at the higher frequency band. Moreover, the capacitively-coupled portion 66 between the first metal portion 14 and the second metal portion 15 could enable the open-loop antenna to generate a wideband resonant mode at the higher frequency band, so that the first operating band 71 of the multiband antenna 6 could be formed with a wide operating bandwidth. In addition, the capacitively-coupled portion 66 and the shorting metal portion 152 of the second metal portion 15, at a relatively lower frequency band, could equivalently perform as a feeding-matching portion of the multiband antenna 6 for effectively improving the impedance matching of the resonant mode generated at the lower frequency band, so that the multiband antenna 6 could generate the second operating band 72 with a wide operating bandwidth. From the experimental results, based on the 6 dB return loss definition acceptable for practical application, the first operating band 71 generated by the multiband antenna 6 covers the penta-band operation of GSM1800/GSM1900/UMTS/LTE2300/LTE2500 (1710~2690 MHz) systems, and the second operating band 72 generated by the multiband antenna 6 covers the tri-band operation of LTE700/GSM850/GSM900 (698~960 MHz) systems. Thus, the multiband antenna 6 could meet the bandwidth requirements of the LTE/GSM/UMTS systems for wideband and multiband operation.

Figure 8:
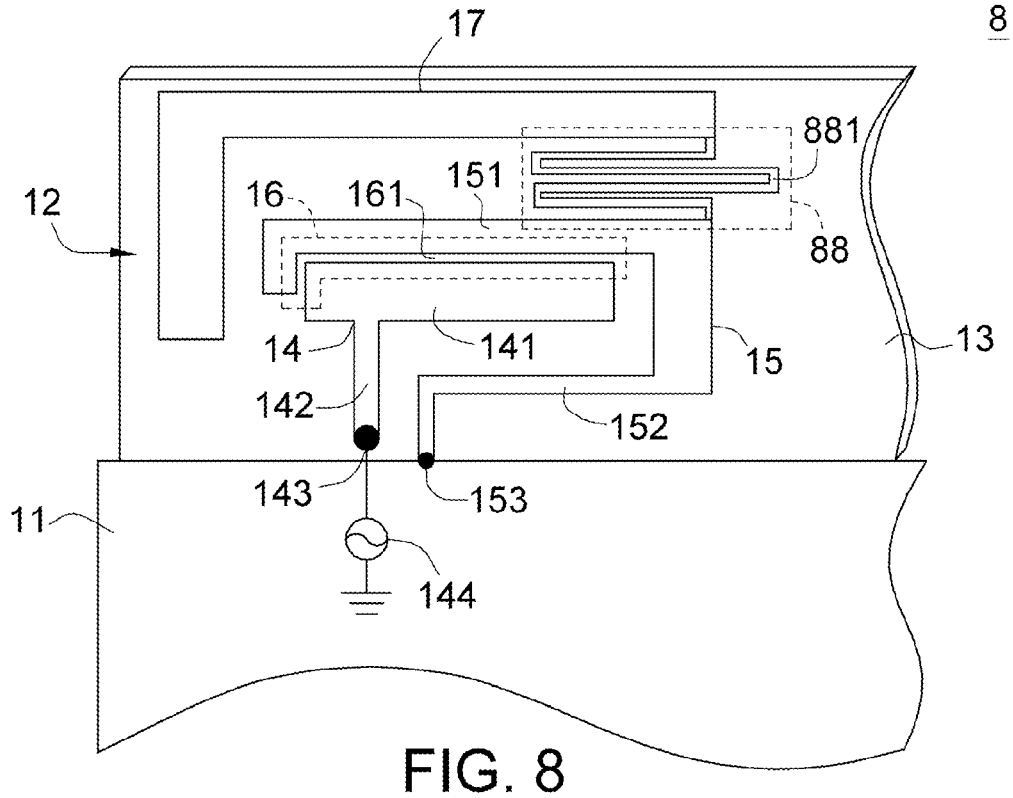
FIG. 8 shows a schematic diagram of a multiband antenna 8 according to an embodiment of this disclosure.

FIG. 8 shows a schematic diagram of a multiband antenna 8 according to an embodiment of this disclosure. The multiband antenna 8 comprises a ground plane 11 and a radiating portion 12. The radiating portion 12, located on a dielectric substrate 13, comprises a first metal portion 14, a second metal portion 15, an inductively-coupled portion 88 and a third metal portion 17. The first metal portion 14 comprises a first coupling metal portion 141 and a signal feeding line 142. The signal feeding line 142 is electrically connected to the first coupling metal portion 141 and has a signal feeding point 143. The signal feeding point 143 is connected to a signal source 144. The second metal portion 15 comprises a second coupling metal portion 151 and a shorting metal portion 152. The shorting metal portion 152 is electrically connected to the second coupling metal portion 151 and has a shorting point 153 electrically connected to the ground plane 11. The second coupling metal portion 151 is coupled to the first coupling metal portion 141 to form a capacitively-coupled portion 16, wherein there is a coupling slit 161 between the second coupling metal portion 151 and the first coupling metal portion 141. The inductively-coupled portion 88 is connected between the third metal portion 17 and the second metal portion 15. The inductively-coupled portion 88 has a meandered metal line 881, wherein the width of the meandered metal line should be less than or equal to 1 mm. The major difference between the multiband antenna 8 and the multiband antenna 1 is that the lumped inductor 181 is replaced by a meandered metal line 881. However, the inductively-coupled portion 88 formed by the meandered metal line 881 could also equivalently function like the inductively-coupled portion 18 of the multiband antenna 1 of FIG. 1. Thus, the antenna performance similar to that of the multiband antenna 1 could also be achieved by the multiband antenna 8.

Figure 9A:
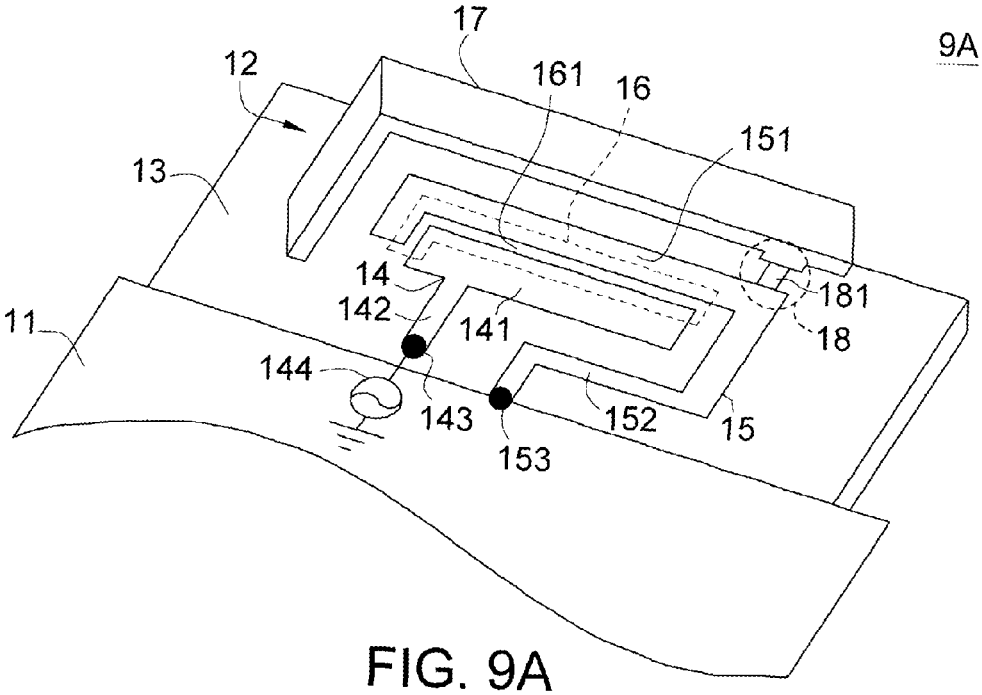
FIGS. 9A and 9B are schematic diagrams of two embodiments of this disclosure showing radiating portions 12 of the multiband antenna to be implemented in different three-dimensional structures, respectively.
Figure 9B:
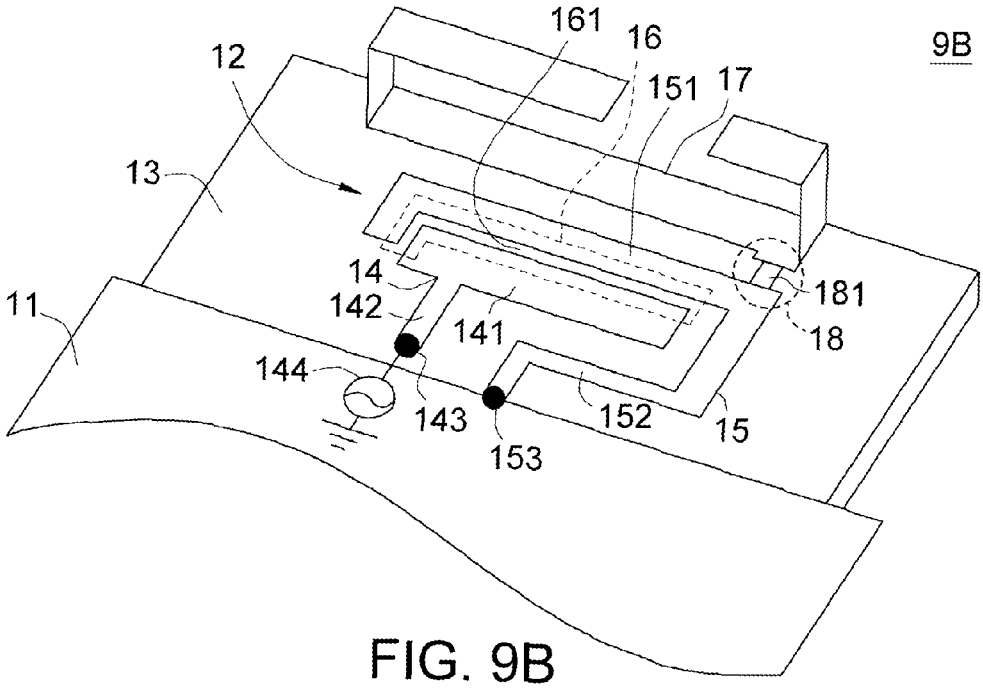
Figure 9C:
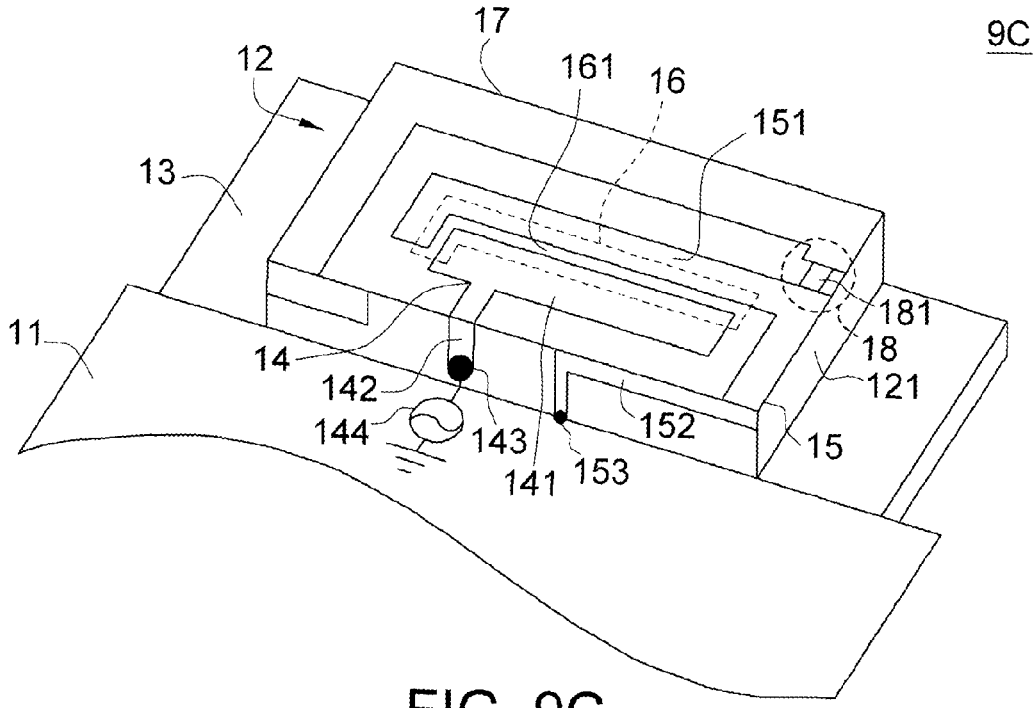
FIGS. 9C and 9D are schematic diagrams of two embodiments of this disclosure showing radiating portions 12 of the multiband antenna to be implemented in different three-dimensional structures and on the surfaces of different supporting members 121, respectively.
Figure 9D:
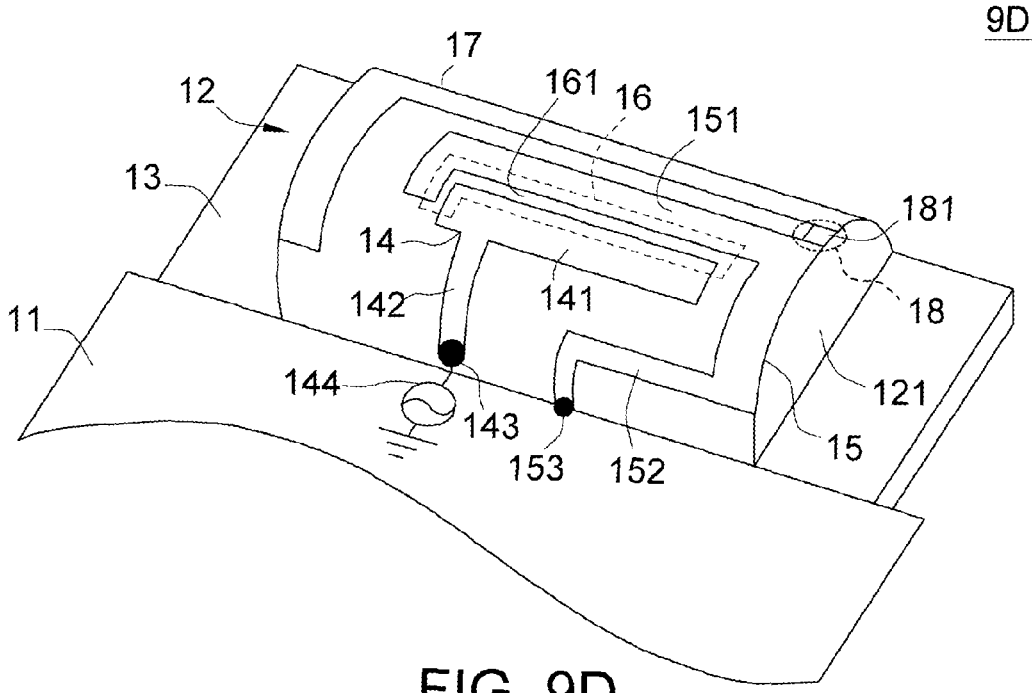

In addition to the above embodiments, other embodiments according to the disclosed multiband antenna (such as multiband antenna 1, 3, 5, 6, or 8) can include a radiating portion 12 implemented in different three-dimensional (3-D) structures or on the surfaces of different supporting members 121 located on or above the dielectric substrate 13. For example, FIGS. 9A and 9B illustrate two embodiments of the radiating portion 12 of the disclosed multiband antenna to be implemented in different 3-D structures and located on the dielectric substrate 13, wherein the third metal portion 17 is constructed in a 3-D structure. FIGS. 9C and 9D illustrate two embodiments of the radiating portion 12 of the disclosed multiband antenna to be implemented in different 3-D structures and on the surfaces of different supporting members 121, wherein the supporting member 121 could be a cube or have a curved surface. The antenna performance similar to that of the multiband antenna 1 could also be achieved by the multiband antennas of FIGS. 9A, 9B, 9C and 9D.

The multiband antenna disclosed in the above embodiments comprises a ground plane and a radiating portion. The radiating portion, which could be implemented in a planar structure or a 3-D structure, is located on or above a dielectric substrate and comprises a first metal portion, a second metal portion, an inductively-coupled portion and a third metal portion. The first metal portion comprises a first coupling metal portion and a signal feeding line. The signal feeding line is electrically connected to the first coupling metal portion and has a signal feeding point. The signal feeding point is connected to a signal source. The second metal portion comprises a second coupling metal portion and a shorting metal portion. The shorting metal portion is electrically connected to the second coupling metal portion and has a shorting point electrically connected to the ground plane. The second coupling metal portion is coupled to the first coupling metal portion to form a capacitively-coupled portion, wherein there is at least one coupling slit between the second coupling metal portion and the first coupling metal portion. The inductively-coupled portion is connected between the third metal portion and the second metal portion. The inductively-coupled portion may include a lumped inductive element, a low-pass filter, a band-stop filter, or a meandered metal line, and could have high input impedance when the antenna operates at a higher frequency band. Thus, an open-loop antenna could equivalently formed by the first and the second metal portions for the multiband antenna to generate a first operating band. Moreover, the capacitively-coupled portion between the first metal portion and the second metal portion could enable the open-loop antenna to generate a wideband resonant mode at the higher frequency band, so that the first operating band of the multiband antenna could be formed with a wide operating bandwidth. Further, the capacitively-coupled portion and the shorting metal portion of the second metal portion, at a relatively lower frequency band of the multiband antenna, could equivalently perform as a feeding-matching portion of the multiband antenna for effectively improving the impedance matching of the resonant mode generated at the lower frequency band, so that the multiband antenna could generate a second operating band with a wide operating bandwidth. The frequencies of the second operating band are lower than those of the first operating band. Thus, when the multiband antenna disclosed in the above embodiments is used in a wireless or mobile communication device, the communication device could meet the bandwidth requirement of the LTE/GSM/UMTS systems for wideband and multiband operation. In addition to achieving the requirements of being capable of wideband and multiband operation, the disclosed multiband antenna could also be implemented in a compact antenna size, and could be easily integrated in a wireless or mobile communication device. Furthermore, for practical application, a wireless or mobile communication device could also be integrated with multiple disclosed multiband antennas to realize a multi-input multi-output (MIMO) antenna architecture, so that the wireless or mobile communication device could achieve higher data transmission rates.

The disclosed embodiments of multiband antennas could be used in various devices with wireless or mobile communication function. Examples of the mobile communication or computing devices are such as mobile phones, navigating systems, electronic books, personal digital assistants and multi-media players, computer systems such as vehicle computers, notebook computers, and personal computer, equipment for telecommunication or network, and peripheral equipment for computer or network such as routers, IP sharing device (i.e., network address translation device), wireless network cards, and so on.

Figure 10A:
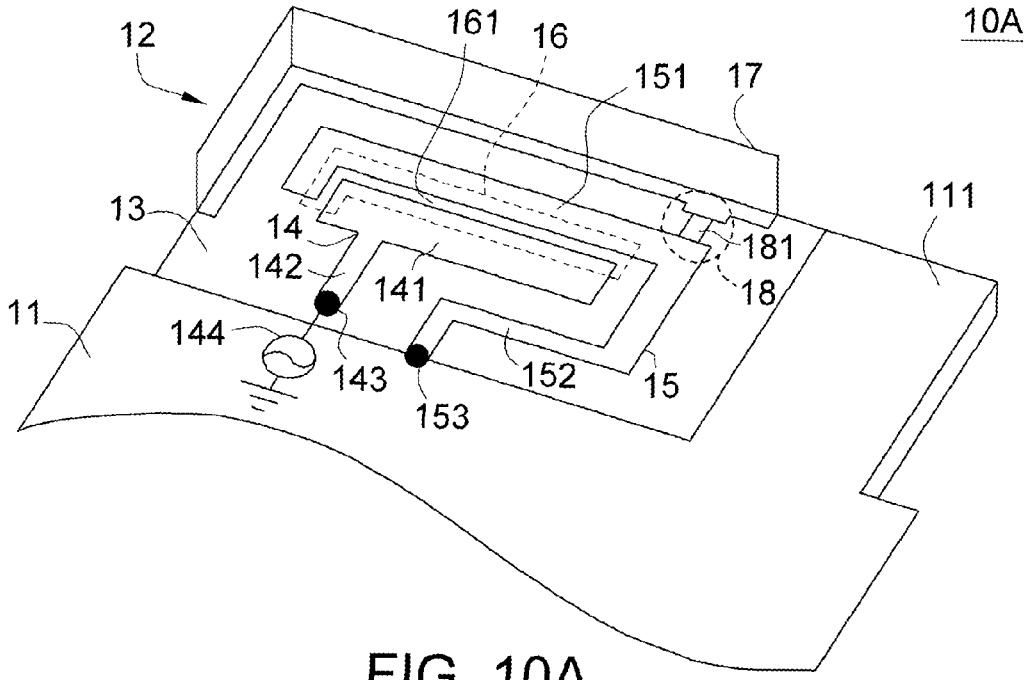
FIG. 10A is a schematic diagram showing an embodiment of the multiband antenna of this disclosure to be implemented with a ground plane 11 having a partial region 111 extended beside the radiating portion 12.
Figure 10B:
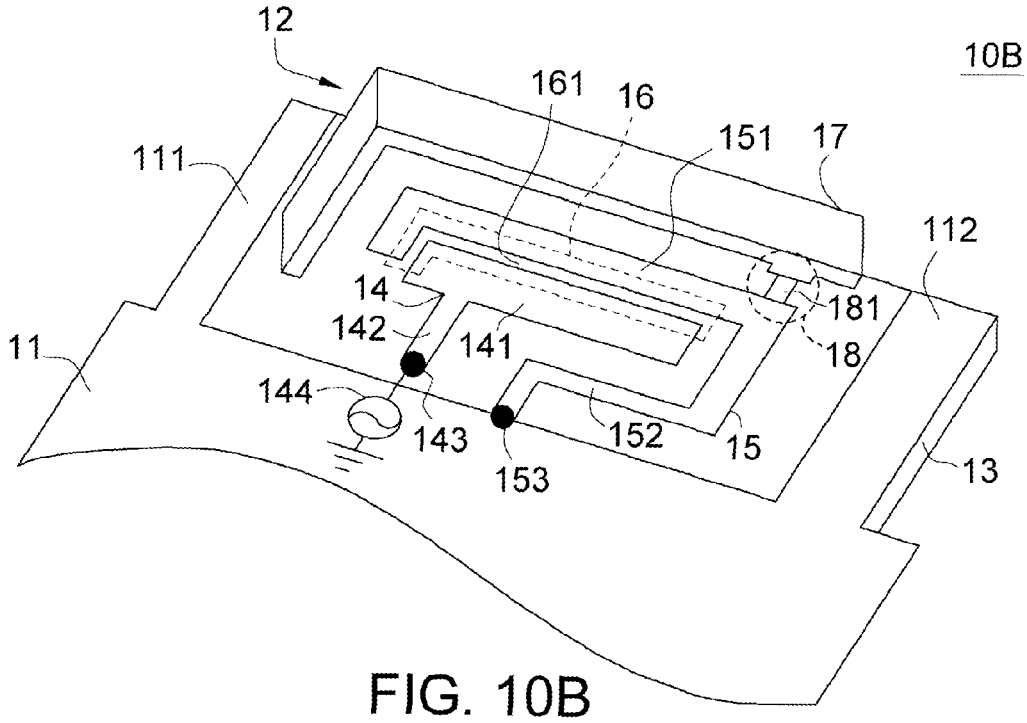
FIG. 10B is a schematic diagram showing an embodiment of the multiband antenna of this disclosure to be implemented with a ground plane 11 having partial regions 111 and 112 extended beside the radiating portion 12.
Figure 10C:
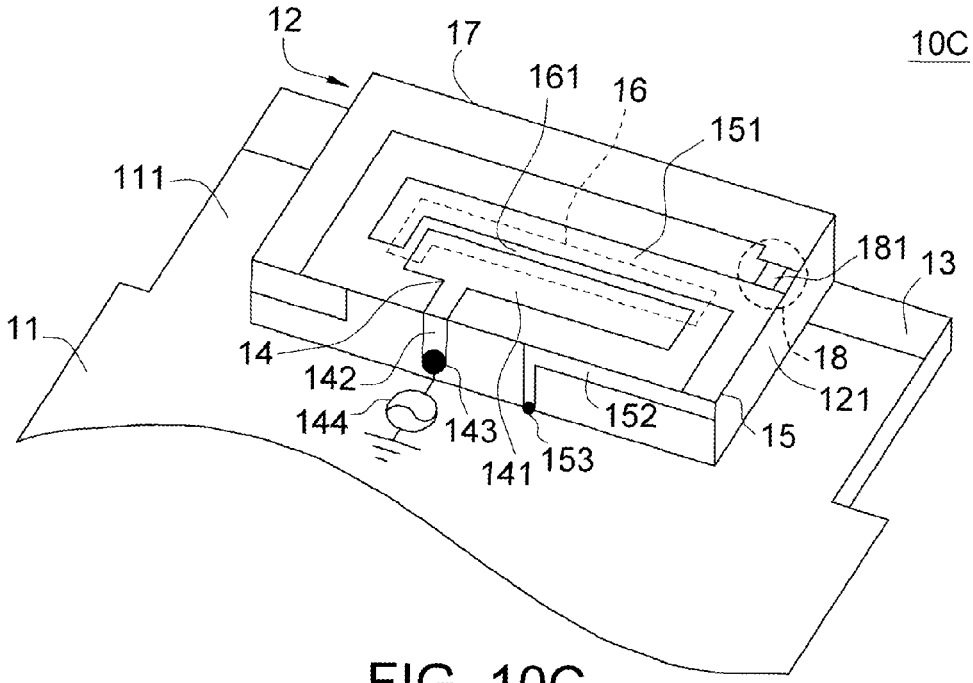
FIGS. 10C and 10D are schematic diagrams showing two embodiments of multiband antennas of this disclosure to be implemented respectively with two examples of a ground plane 11 having a partial region 111 extended below the radiating portion 12.
Figure 10D:
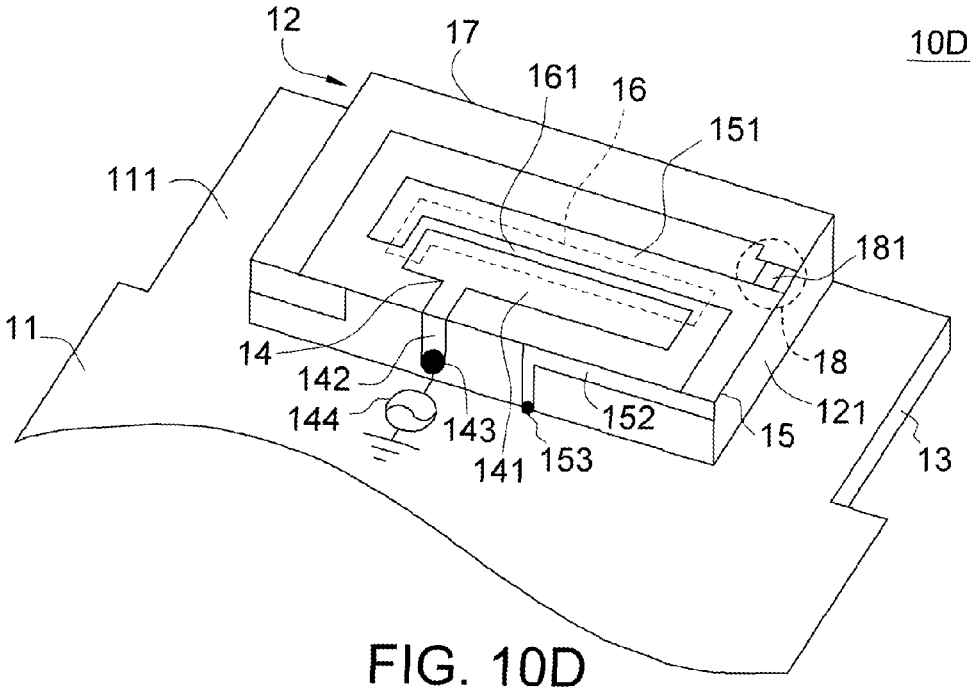
Figure 10E:
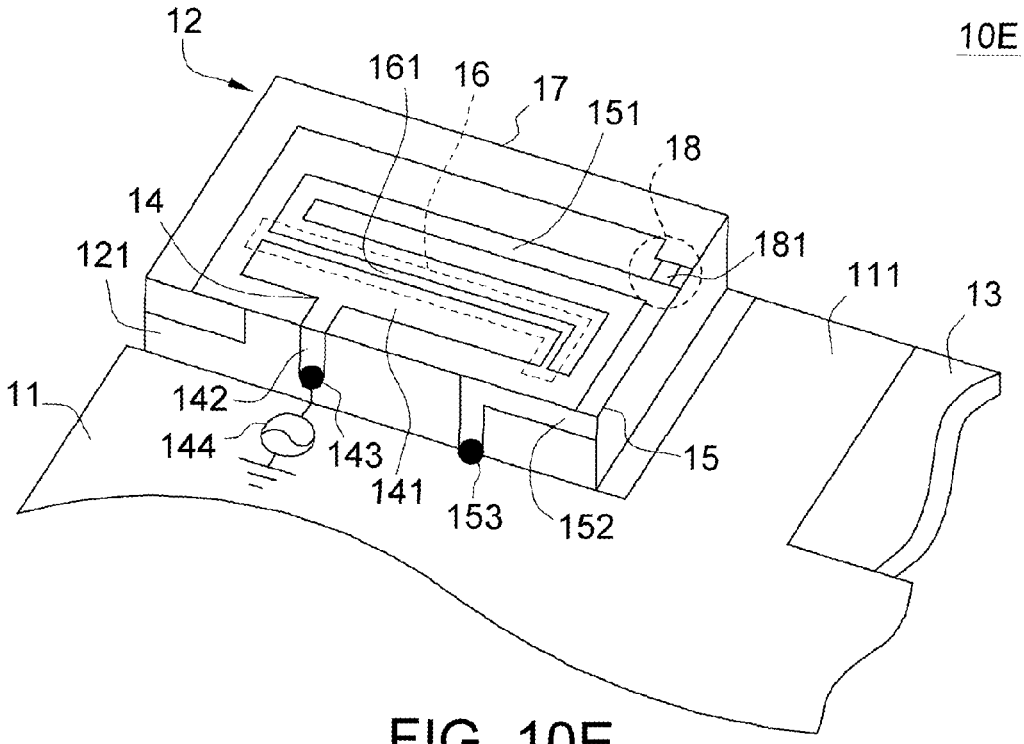
FIGS. 10E and 10F are schematic diagrams showing two embodiments of multiband antennas of this disclosure to be implemented respectively with two examples of a ground plane 11 having a partial region 111 extended beside the radiating portion 12.
Figure 10F:
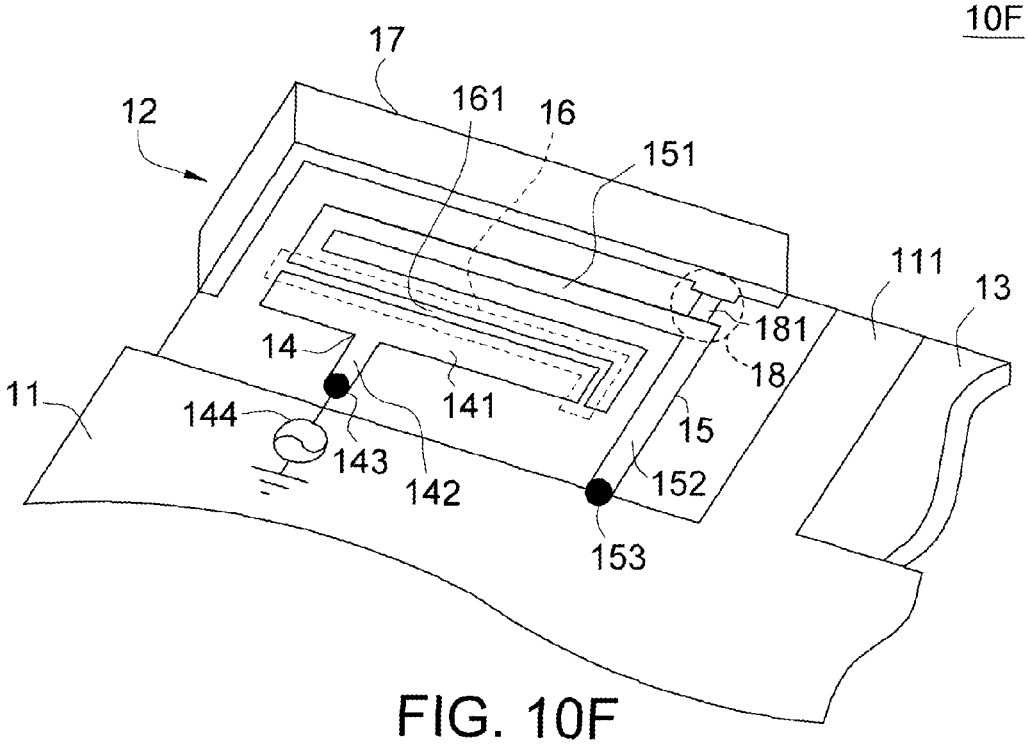

Besides, the ground plane 11 of the disclosed multiband antenna (such as multiband antennas 1, 3, 5, 6, 8, 9A, 9B, 9C, and 9D) may have a partial region extended beside or below of the radiating portion 12. FIG. 10A shows an embodiment of the ground plane 11 of the multiband antenna having a partial region 111 extended beside the radiating portion 12. FIG. 10B shows an embodiment of the ground plane 11 of the multiband antenna having partial regions 111 and 112 extended beside the radiating portion 12. FIGS. 10C and 10D show two embodiments of the ground plane 11 of the multiband antenna having a partial region 111 extended below the radiating portion 12. FIGS. 10E and 10F show two other embodiments of the ground plane 11 of the multiband antenna having a partial region 111 extended beside the radiating portion 12.

When the ground plane 11 of the disclosed multiband antenna has a partial region 111 extended beside or below the radiating portion 12, the antenna performance similar to that of the multiband antenna 1 of FIG. 1 could also be obtained. In addition, the partial region 111 or 112 of the ground plane 11 extended to the vicinity of the radiating portion 12 could be further used for placing other energy transmission elements, such as connectors for universal serial bus (USB), speaker elements, antenna elements or integrated circuit (IC). Besides, the partial region of the ground plane 11 extended to the vicinity of the radiating portion 12 could also shield the user's head or body from the near-field electromagnetic radiation energy of the radiating portion 12. Thus, when the disclosed multiband antenna is employed in a communication device, it could reduce the measured electromagnetic wave specific absorption rate (SAR) of the communication device or make the communication device meet the hearing-aid capability (HAC) standard.

FIGS. 11A, 11B, 11C, 11D, 11E, 11F, and 11G respectively show schematic diagrams of embodiments of antennas implemented according to a method for an antenna to be capable of multiband operation. The method comprises the following steps. An inductively-coupled portion 1101 is connected between an open-loop metal portion 1102 and an extended metal portion 1103 to form an antenna. In the antenna, the open-loop metal portion 1102 comprises a first metal portion 1104 connected to a signal source 1106 and at least one second metal portion 1107 shorted to a ground plane 1109, wherein there is a capacitively-coupled portion 1110 between the first metal portion 1104 and the at least one second metal portion 1107. When the antenna operates at a higher frequency band, the inductively-coupled portion 1101 enables the open-loop metal portion 1102 to equivalently perform as another open-loop antenna to generate a first operating band for the antenna. When the antenna operates at a relatively lower frequency band, the open-loop metal portion 1102 equivalently performs as a feeding-matching portion of the extended metal portion 1103 to enable the antenna to generate a second operating band. The frequencies of the second operating band are lower than those of the first operating band.

Figure 11A:
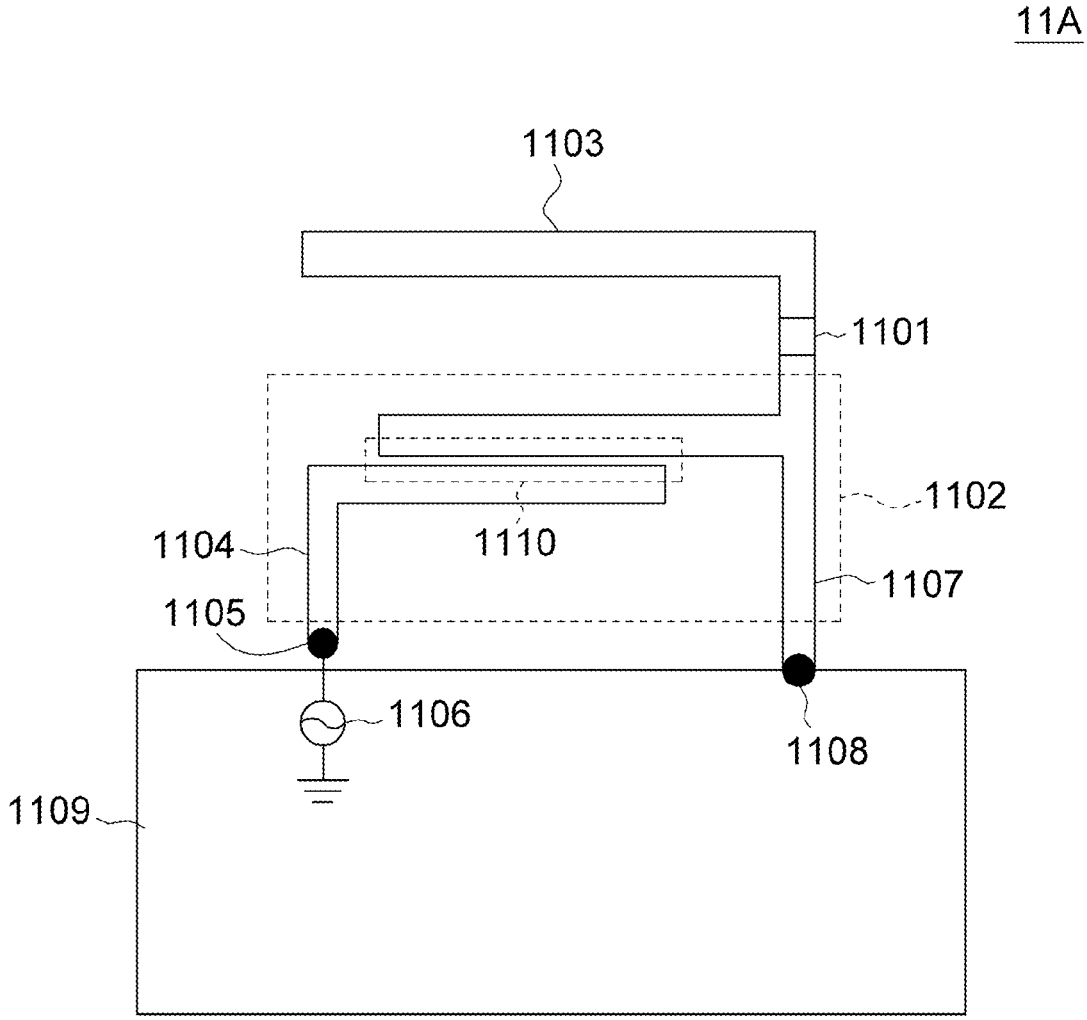
FIGS. 11A, 11B, 11C, 11D, 11E, 11F, and 11G respectively show schematic diagrams of embodiments of antennas implemented according to a method for an antenna to be capable of multiband operation.
Figure 11B:
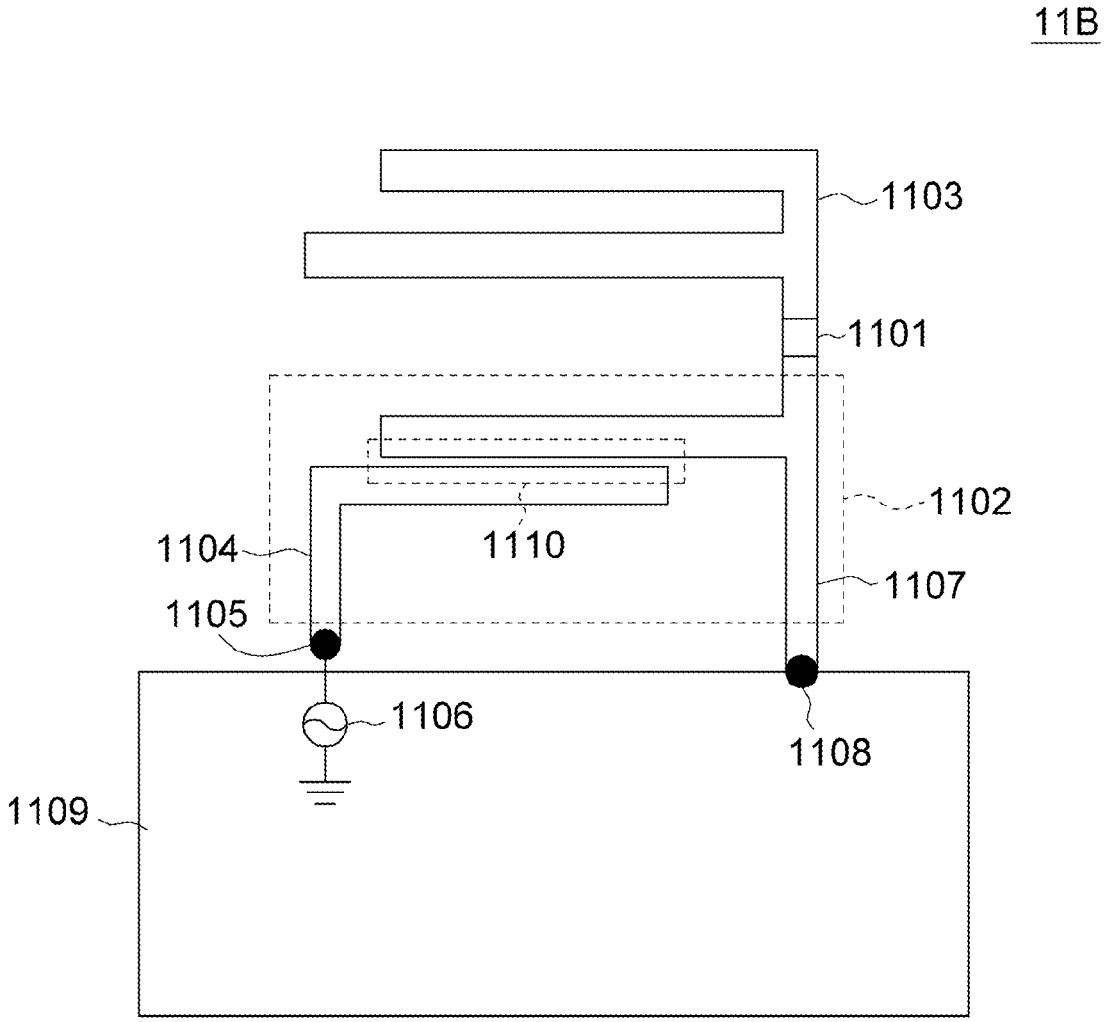
Figure 11C:
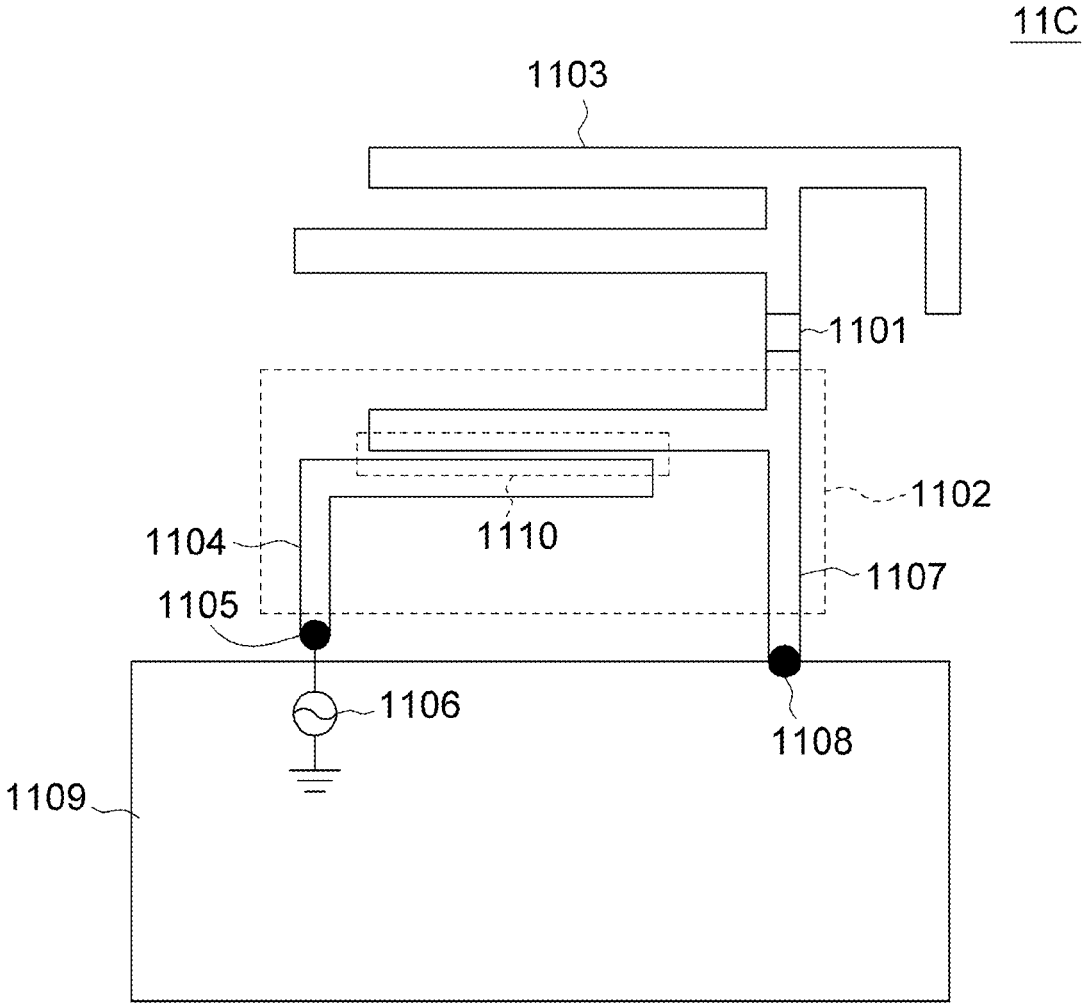
Figure 11D:
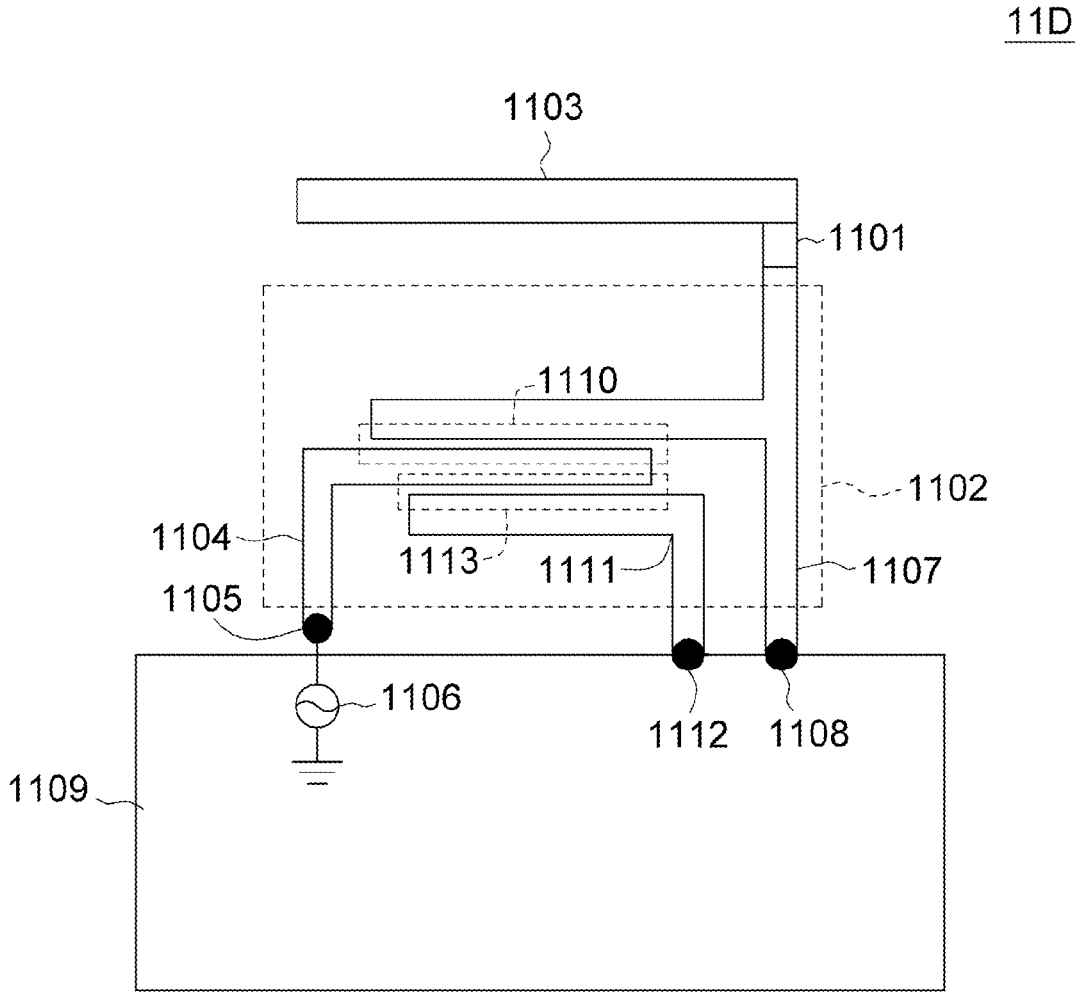
Figure 11E:
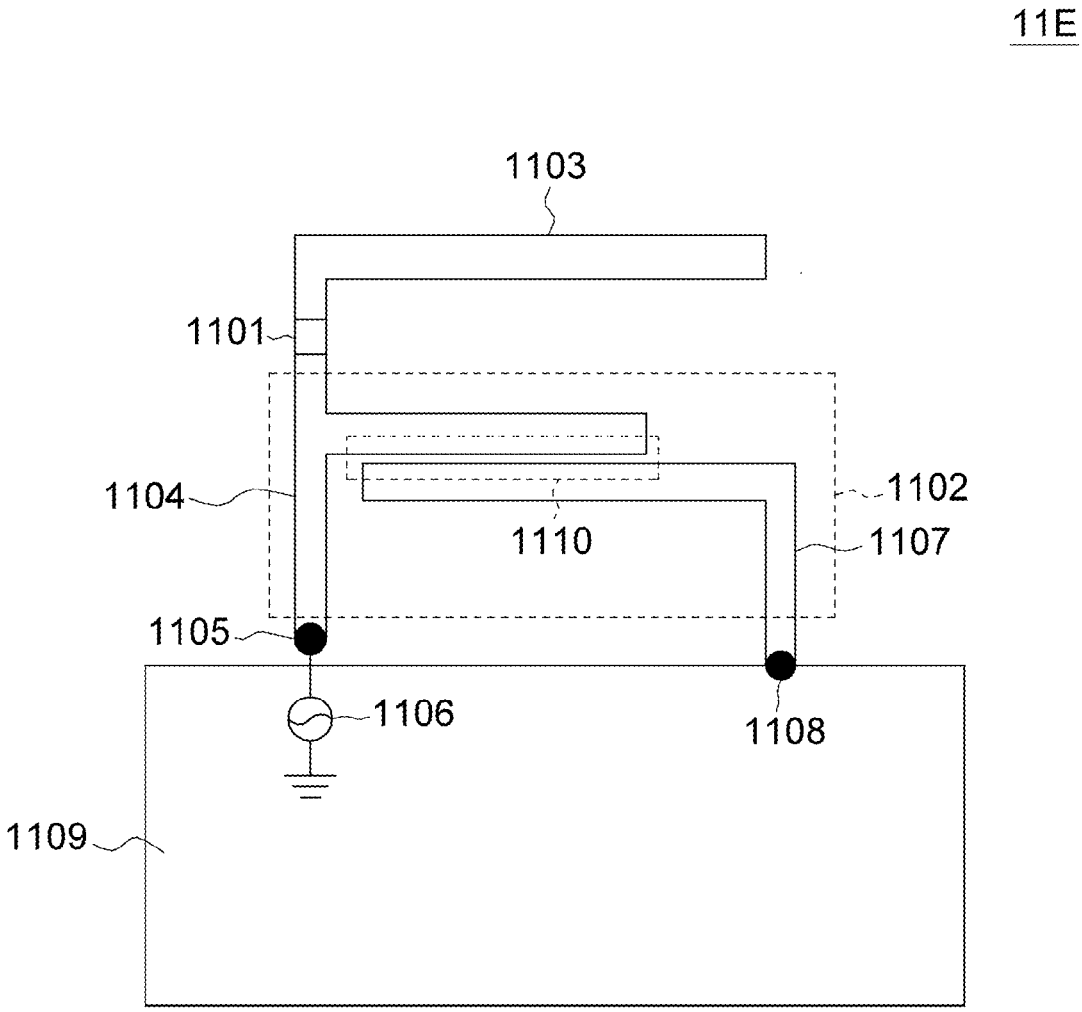
Figure 11F:
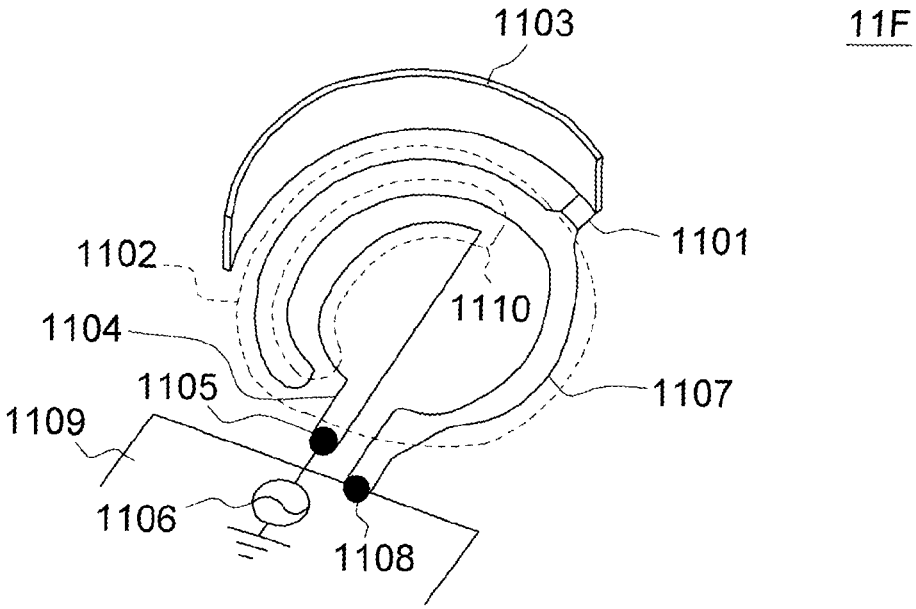
Figure 11G:
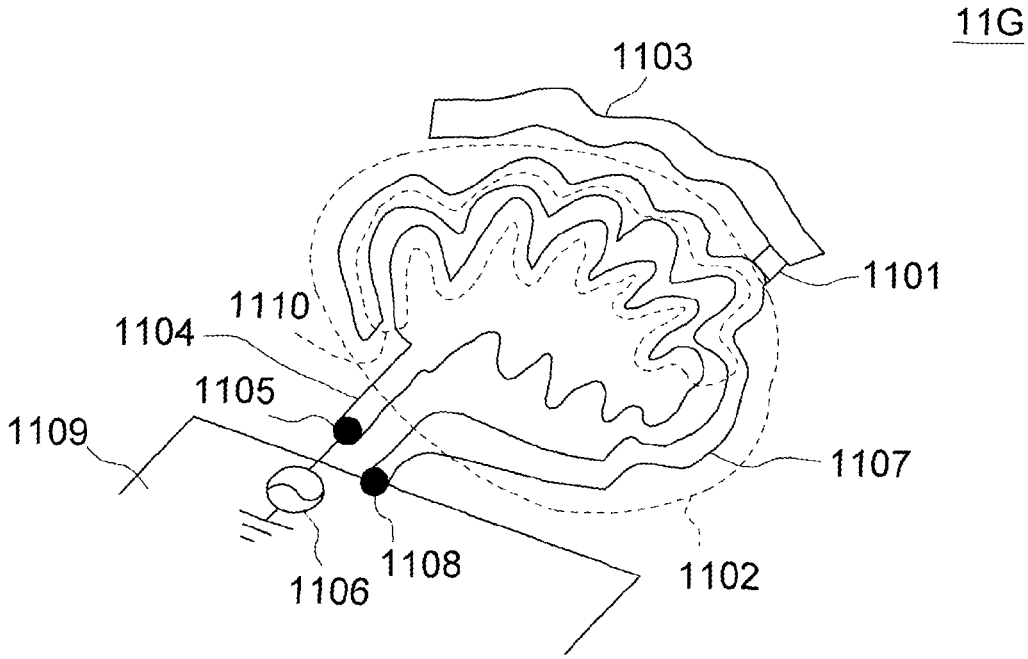

In the present method, the inductively-coupled portion 1101 could be a low-pass filter circuit, element or circuit layout, which has high input impedance at the higher frequency band so that the open-loop metal portion 1102 could equivalently perform as another open-loop antenna to generate the first operating band of the antenna. Besides, when the antenna operates at the relatively lower frequency band, the at least one second metal portion 1107 and the at least one capacitively-coupled portion 1110 of the open-loop metal portion 1102, could equivalently perform as a feeding-matching portion of the extended metal portion 1103 to generate the second operating band of the antenna. The inductively-coupled portion 1101 could be connected between the extended metal portion 1103 and the at least one second metal portion 1107 of the open-loop metal portion 1102 as shown in FIGS. 11A, 11B, 11C, 11D, 11F, 11G, or connected between the extended metal portion 1103 and the first metal portion 1104 of the open-loop metal portion 1102 as shown in FIG. 11E. As shown in FIGS. 11B and 11C, the extended metal portion 1103 comprises a plurality of metal branches. In a method for an antenna to be capable of multiband operation disclosed, the extended metal portion 1103, the first metal portion 1104 and the at least one second metal portion 1107 could be formed in other shapes with smooth curves as shown in FIGS. 11F and 11G.

In the present method, the inductively-coupled portion, the extended metal portion, and the open-loop metal portion could be implemented according to each of the above embodiments so as to all achieve multiband antenna designs. In addition, as disclosed in the above embodiments, the disclosed method enables the antenna to be capable of multiband operation.

According to the method for an antenna to be capable of multiband operation disclosed in the above embodiments, an antenna is implemented by connecting an inductively-coupled portion between an open-loop metal portion and an extended metal portion. The open-loop metal portion has a first metal portion to be connected to a signal source and at least one second metal portion shorted to a ground plane, and there is at least one capacitively-coupled portion to be formed between the first metal portion and the at least one second metal portion. When the antenna operates at a higher frequency band, the inductively-coupled portion of the antenna could perform as a band-stop filter or low-pass filter, which could generate high input impedance, so that the open-loop metal portion of the antenna could equivalently perform as another open-loop antenna to generate a first operating band of the antenna. Besides, the capacitively-coupled portion of the open-loop metal portion could enable the open-loop antenna to generate a wideband resonant mode at the higher frequency band, so that the first operating band of the antenna could be formed with a wide operating bandwidth. Moreover, when the antenna operates at a relatively lower frequency band, the second metal portion and the capacitively-coupled portion of the open-loop metal portion could equivalently perform as a feeding-matching portion of the extended metal portion for effectively improving the impedance matching of the resonant mode generated at the relatively lower frequency band. Thus, the antenna could generate a second operating band with a wide operating bandwidth when the antenna operates at the lower frequency band.

The antenna designed according to the method of this disclosure not only could enable the antenna to be capable of multiband operation but also could achieve the antenna with a compact size. Thus, the antenna could be easily integrated or used in wireless or mobile communication devices. In practical application, the disclosed multiband antenna could be integrated in a wireless or mobile communication device with a compact antenna size, so that multiple disclosed multiband antennas could also be integrated in the wireless or mobile communication device to realize multi-input multi-output (MIMO) antenna architecture. Thus, the wireless or mobile communication device could achieve higher data transmission rates.

While the disclosure has been described by way of examples and in terms of the preferred embodiment (s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multiband antenna comprising a ground plane and a radiating portion disposed on or above a dielectric substrate, wherein the radiating portion comprises:

a first metal portion comprising a first coupling metal portion and a signal feeding line, wherein the signal feeding line is electrically connected to the first coupling metal portion and has a signal feeding point;

a second metal portion comprising a second coupling metal portion and a shorting metal portion, wherein the shorting metal portion is electrically connected to the second coupling metal portion and has a shorting point electrically connected to the ground plane, and the second coupling metal portion is coupled to the first coupling metal portion and a capacitively-coupled portion is formed between the first and the second coupling metal portions;

an inductively-coupled portion; and a third metal portion, wherein the inductively-coupled portion is connected between the third metal portion and the second metal portion, the first and the second metal portions enable the multiband antenna to generate a first operating band, the first, the second and the third metal portions enable the multiband antenna to generate a second operating band, wherein the frequencies of the second operating band are lower than those of the first operating band.

2. The multiband antenna according to claim 1, wherein the signal feeding point is connected to a signal source.

3. The multiband antenna according to claim 1, wherein the capacitively-coupled portion has at least one coupling slit.

4. The multiband antenna according to claim 3, wherein the gap of the coupling slit is less than or equal to one-hundredth wavelength of the lowest operating frequency of the second operating band.

5. The multiband antenna according to claim 1, wherein the capacitively-coupled portion has at least one coupling slit and at least one metal plate.

6. The multiband antenna according to claim 5, wherein the gap of the coupling slit is less than or equal to one-hundredth wavelength of the lowest operating frequency of the second operating band.

7. The multiband antenna according to claim 1, wherein the inductively-coupled portion has a lumped inductive element.

8. The multiband antenna according to claim 1, wherein the inductively-coupled portion has a low-pass filter.

9. The multiband antenna according to claim 1, wherein the inductively-coupled portion has a band-stop filter.

10. The multiband antenna according to claim 1, wherein the inductively-coupled portion performs as a low-pass filter to enable the first and the second metal portions to generate the first operating band for the antenna.

11. The multiband antenna according to claim 1, wherein the inductively-coupled portion performs as a band-stop filter to enable the first and the second metal portions to generate a first operating band for the antenna.

12. The multiband antenna according to claim 1, wherein the inductively-coupled portion has a meandered metal line.

13. The multiband antenna according to claim 12, wherein the width of the meandered metal line is less than or equal to 1 mm.

14. The multiband antenna according to claim 1, wherein the length of the third metal portion is less than or equal to one-fifth wavelength of the lowest operating frequency of the second operating band.

15. The multiband antenna according to claim 1, wherein the radiating portion is a planar structure.

16. The multiband antenna according to claim 1, wherein the radiating portion is a three-dimensional structure.

17. The multiband antenna according to claim 1, wherein the radiating portion is a three-dimensional structure disposed on or above a surface of a supporting member.

18. The multiband antenna according to claim 1, wherein the ground plane has a partial region extended beside the radiating portion or below the radiating portion.

19. A method for an antenna to be capable of multiband operation, for use in a communication device, the method comprising:

connecting an inductively-coupled portion between an open-loop metal portion and an extended metal portion to form an antenna, wherein the open-loop metal portion comprises a first metal portion connected to a signal source and at least one second metal portion shorted to a ground plane, and there is at least one capacitively-coupled portion to be formed between the first metal portion and the at least one second metal portion;

when the antenna operates at a higher frequency band, enabling, by the inductively-coupled portion, the open-loop metal portion to equivalently perform as another open-loop antenna to generate a first operating band for the antenna; and when the antenna operates at a relatively lower frequency band, enabling the open-loop metal portion to equivalently perform as a feeding-matching portion of the extended metal portion to enable the antenna to generate a second operating band, wherein the frequencies of the second operating band are lower than those of the first operating band.

20. The method according to claim 19, wherein the inductively-coupled portion performs as a low-pass filter circuit, element or circuit layout, so that the open-loop metal portion equivalently performs as another open-loop antenna to generate the first operating band of the antenna.

21. The method according to claim 19, wherein the inductively-coupled portion performs as a band-stop filter circuit, element or circuit layout, so that the open-loop metal portion equivalently performs as another open-loop antenna to generate the first operating band of the antenna.

22. The method according to claim 19, wherein the at least one second metal portion and the at least one capacitively-coupled portion of the open-loop metal portion, at the second operating band, enable the open-loop metal portion to equivalently perform as a feeding-matching portion of the extended metal portion to generate the second operating band of the antenna.

23. The method according to claim 19, wherein the extended metal portion comprises a plurality of metal branches.

24. The method according to claim 19, wherein the inductively-coupled portion is connected between the extended metal portion and the at least one second metal portion.

25. The method according to claim 19, wherein the inductively-coupled portion is connected between the extended metal portion and the first metal portion.

* * * * *